US006019713A

United States Patent [19]

Scypinski et al.

[11] Patent Number: 6,019,713

[45] Date of Patent: Feb. 1, 2000

[54] TUBING MACHINE WITH ROTATING FORMER SECTION FOR QUICK CHANGE-OVER

[75] Inventors: Theodore John Scypinski; Roger Kent Jacobson, both of Savannah, Ga.

[73] Assignee: Union Camp Corporation

[21] Appl. No.: 09/156,303

[22] Filed: Sep. 17, 1998

[51] Int. Cl.[7] ..... B31C 13/00; B65B 41/18

[52] U.S. Cl. ..... 493/302; 493/248; 53/201

[58] Field of Search ..... 493/302, 248, 493/468, 473, 476, 436, 438, 439, 440, 443; 53/168, 201, 550, 551, 552, 553; 83/563, 564

[56] References Cited

U.S. PATENT DOCUMENTS 1,669,713 5/1928 Kronmiller .
2,006,332 7/1935 Adams et al. .
2,631,509 3/1953 Whytlaw .
2,742,826 4/1956 Randall .
2,803,176 8/1957 Gazette .
3,225,998 12/1965 Bowman .
4,658,688 4/1987 Shah et al. ..... 83/552
5,537,798 7/1996 Fukuda et al. ..... 53/168
5,715,656 2/1998 Pearce ..... 493/302

*Primary Examiner*—Stephen F. Gerrity
*Assistant Examiner*—Steven Jensen
*Attorney, Agent, or Firm*—Dennis H. Lambert

[57] ABSTRACT

A tube-forming machine has a tube forming section for receiving webs of material and forming it into a tube. The tube-forming section has multiple sets of tube formers for forming different types of tubes, and the tube formers are supported on opposite sides of a former bed that is rotatable to bring one or the other of the sets of tube formers into operative position to form a tube.

22 Claims, 17 Drawing Sheets

TUBING MACHINE WITH ROTATING FORMER SECTION FOR QUICK CHANGE-OVER

BACKGROUND OF THE INVENTION

1. Field of the Invention

This invention relates generally to an apparatus for forming bags, and more particularly, to a tubing machine with a rotating former section for quick changeover from flat tube to gusset tube formers, and vice versa.

2. Description of the Prior Art

Machines for making bags, especially from paper, include tubing machines which form a tube from flat sheets of paper supplied to a tube-forming section. The tube is then separated into discrete open-ended tubes of predetermined length, which are subsequently provided with a bottom and/or top, and possibly other structure, such as a handle, for example, to form a bag.

The tube-forming section of a conventional tubing machine typically forms either a flat tube or a gusset tube. In a flat tube, the opposite edges of the sheets of paper supplied to the tube former are folded inwardly into overlapping relationship with one another to form a flattened tube for subsequent processing. In a gusset tube, the opposite edges of the sheets of paper are also folded inwardly into overlapping relationship with one another, but the opposite sides of the tube thus formed are indented or gusseted to form gusseted sides on the tube.

Conventional tube forming machines include one or more rolls of paper, depending upon how many plies are desired in the bag, arranged to supply continuous flat sheets of paper through apparatus which aligns the edges of the sheets as desired, perforates the sheets and applies adhesive in predetermined patterns to form a lamination consisting of multiple plies of paper, which is then pulled through a tube-forming section that folds the sheets of paper into a tubular configuration. The thus-formed tube is then passed through a breakerhead machine which separates the tubular structure into a plurality of discrete tubes of predetermined length, which are then conveyed through a counter/stacker unit for counting and stacking the discrete tubular sections into bundles for subsequent handling, e.g., applying one or more bag ends and/or handles or other features to the bag.

Conventional apparatus may also include a printing section for applying graphics to an outer ply, and/or one or more of the plies may comprise a plastic or other material to achieve a desired property in the completed bag. The tube-forming section of a conventional machine includes a flat, horizontal former bed positioned to receive the laminated plies of paper as they move from a pasting unit and registration device. The tube-forming section folds the paper into a tube configuration before passing it to the breakerhead unit, which separates the tube into a plurality of discrete tubes of predetermined length. Suitable rollers and paper guides (tube formers) are mounted to the former bed for contacting the paper passing over the former bed to fold it into either a flat tube or a gusseted tube. If a flat tube is being formed, formers of a first type are mounted to the bed, and if a gusseted tube is being formed, formers of a different type are mounted to the former bed. The tube forming section in a conventional tubing machine is thus capable of forming only one type of bag, e.g., flat or gusseted. In order to change from making one type of tube to another, it is necessary to replace the formers on the former bed. This takes considerable time, thereby reducing the production capacity of the machine. Moreover, considerable labor and effort are required in order to make the change-over.

Accordingly, there is need for a tube-forming machine which has a tube-forming section that enables quick change-over from making one type of bag to another type of bag, e.g., from making flat tubes to making gusseted tubes.

SUMMARY OF THE INVENTION

In accordance with the present invention, the tube-forming section of a tubing machine is provided with multiple sets of formers for producing different styles of tubes, e.g., flat or gusseted, and the sets are selectively positionable to position one or the other of the sets for operating on the paper supplied to the tube forming section to produce the desired style of tube, e.g., flat or gusseted.

To accomplish this, the former bed is mounted to a rotatable member at one end and to a central pivot at its other end, whereby the former bed may be quickly and easily rotated to invert it to place either side in an operative position to receive the paper supplied to the tube-forming section. Appropriate formers for making either a flat tube or a gusseted tube, for example, are mounted to the respective opposite sides of the former bed, whereby when the former bed is oriented with one side up, it is operative to produce a flat tube, and when oriented with its opposite side up, it is operative to produce a gusseted tube.

No other modification to the tube-forming machine is necessary, and all other components may remain conventional. Moreover, the formers mounted to the respective opposite sides of the former bed may be conventional in structure and operation for forming an appropriate style bag, e.g., either flat or gusseted.

To change the tube-forming section from making one type of tube to another, it is necessary only to stop the machine, break or cut the sheets of paper exiting the pasting unit at the inlet end of the former bed, and cut the paper at the exit end of the former bed. The former bed is then rotated to invert it and bring a different set of formers into registry with the exit from the pasting unit. The sheet of paper is then fed from the pasting unit across the former bed and past the tube formers and into the breakerhead machine, after which the machine may again be started.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
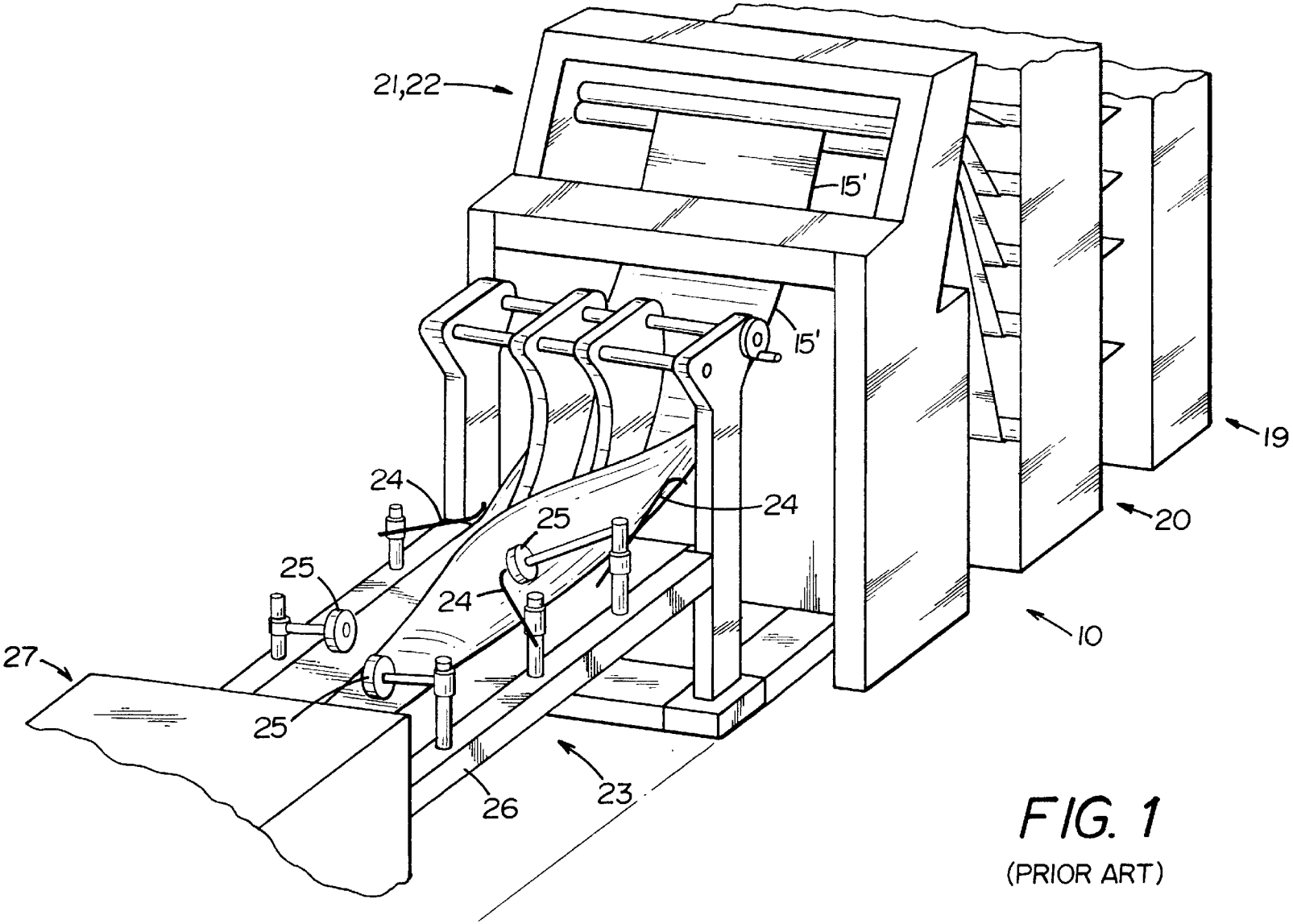
FIG. 1 (PRIOR ART)
FIG. 1 is a fragmentary front perspective view of a portion of a conventional tube-forming machine.
Figures 2A, 2B:
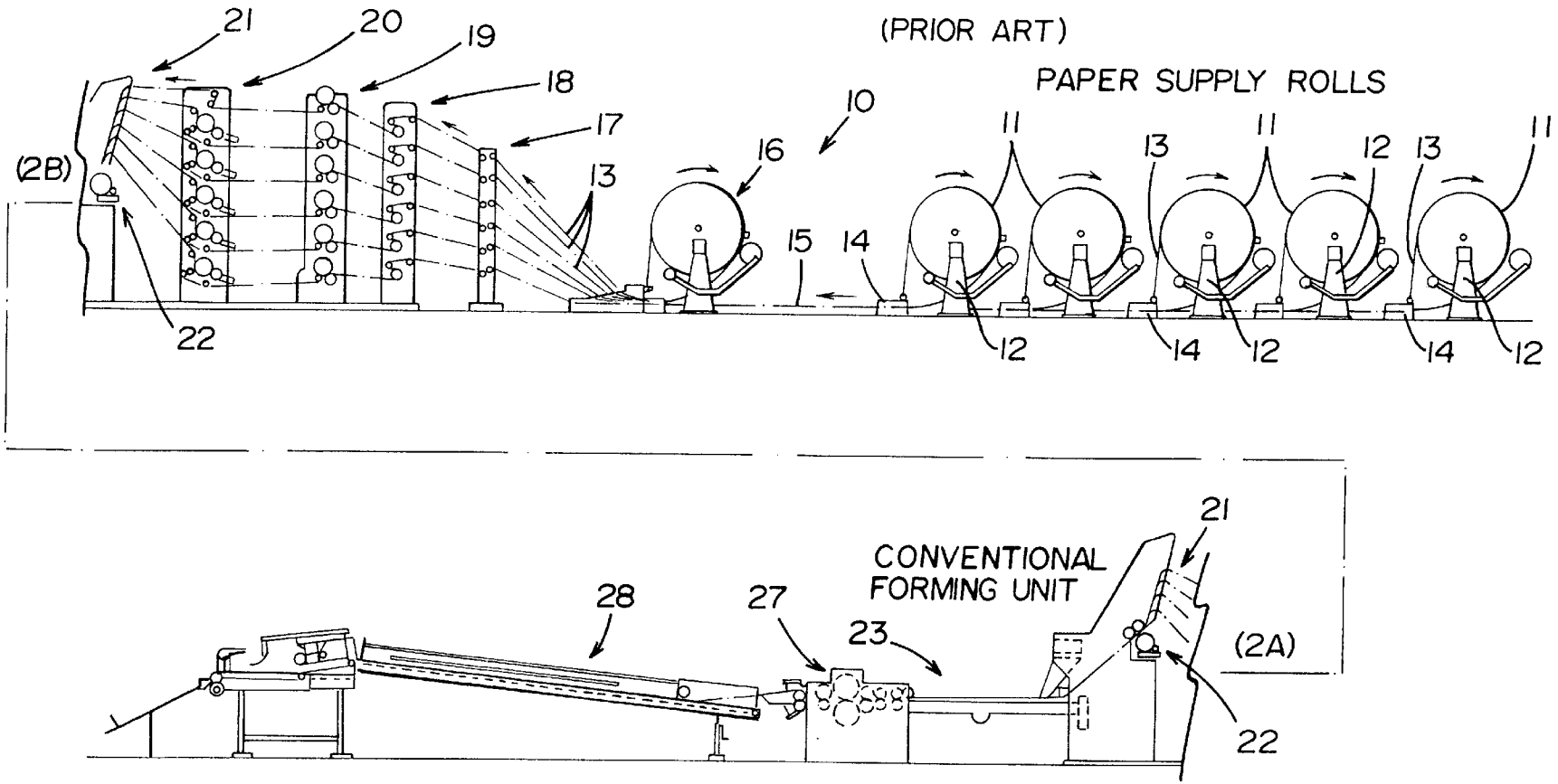
FIG. 2A (PRIOR ART)
FIG. 2B (PRIOR ART)
FIG. 2A is a somewhat schematic side view in elevation of a portion of the conventional tube-forming machine of FIG. 1.
FIG. 2B is a continuation of FIG. 2A, and is a somewhat schematic side view in elevation of the remainder of the tube-forming machine shown in FIGS. 1 and 2A.
Figures 3A, 3B:
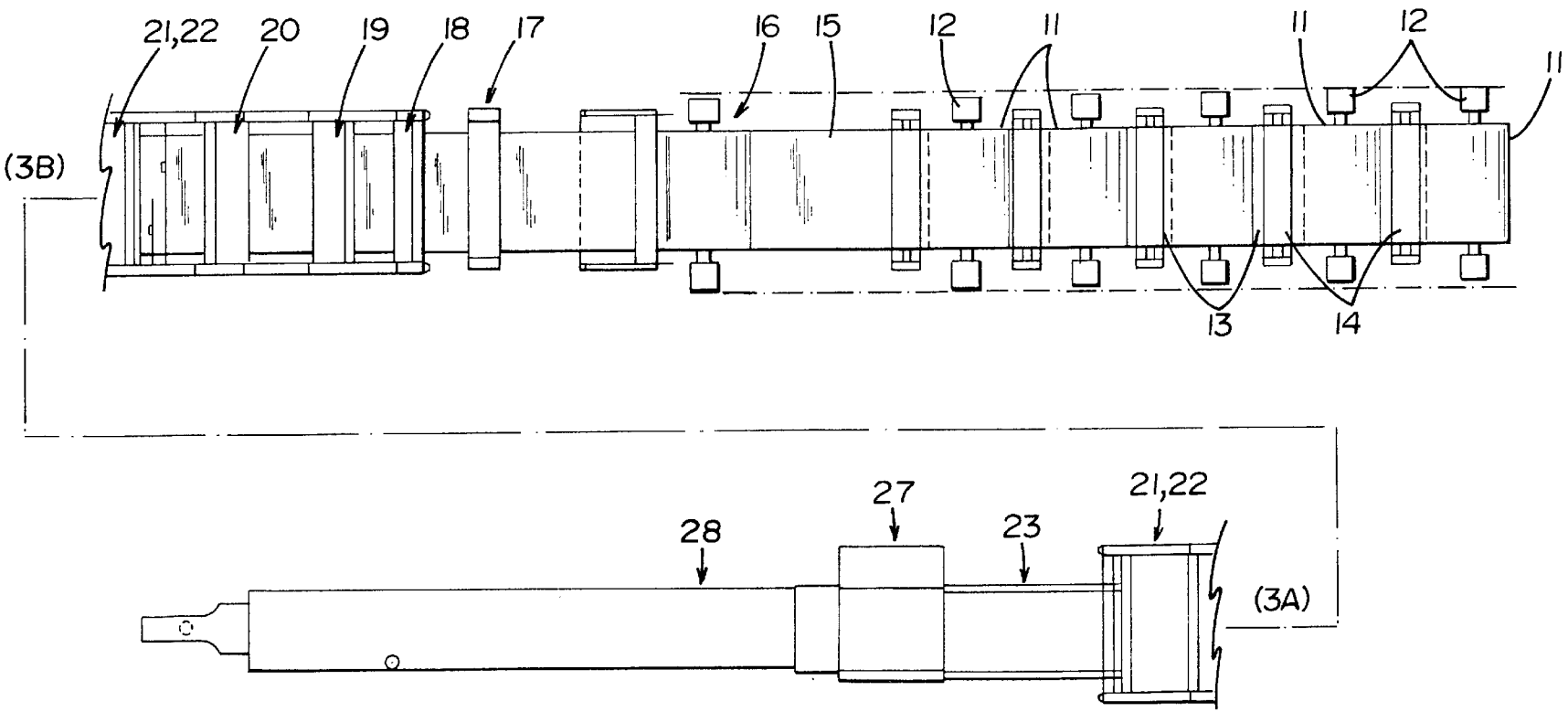
FIG. 3A (PRIOR ART)
FIG. 3B (PRIOR ART)
FIG. 3A is a somewhat schematic top plan view of that portion of the machine shown in FIG. 2A.
FIG. 3B is a somewhat schematic top plan view of that portion of the machine shown in FIG. 2B, and is a continuation of FIG. 3A.

A conventional tube-forming machine as used in the manufacture of paper bags is indicated generally at 10 in FIGS. 1–3B, and includes a plurality of paper supply rolls 11 supported on trunnions 12 arranged to supply webs of paper 13 past web guide rolls 14 to form a multi-ply web of paper 15 that is directed to an unwinding unit 16 and thence to a web edge guide unit 17 that aligns and properly registers the edges of the webs of paper 13. The webs of paper 13 are then fed through a loop draw device 18 which functions to maintain proper tension on the webs of paper, and thence to a perforating device 19 which perforates the webs of paper in a desired pattern of perforations. These perforations may include perforations distributed throughout the web, and particularly includes lines of perforations extending transversely across the width of the webs to define a frangible area that enables separation of the webs into discrete lengths, as described later. The webs of perforated paper then pass through a cross-pasting device 20 which applies adhesive to the webs in a desired pattern.

The webs of perforated and cross-pasted paper then pass through a set of register rollers 21 and a length pasting unit 22 which applies adhesive longitudinally of the webs of paper along at least one of their exposed edges to form a longitudinal seam when the paper is formed into a tubular configuration in the tube-forming section.

From the length pasting unit 22, the multi-ply web 15' of paper enters the tube forming unit 23, which has a plurality of tube formers, including shaped guide rods 24 and rollers 25, which engage the paper as it enters the tube-forming section 23 and fold the edges inwardly into overlapping relationship with one another to form a tube with the opposite sides flattened or creased. The former rods 24 and rollers 25 are mounted to a former bed 26 that is fixed in position to receive the web of paper 15' as it leaves the length pasting unit 22.

Figure 4A:
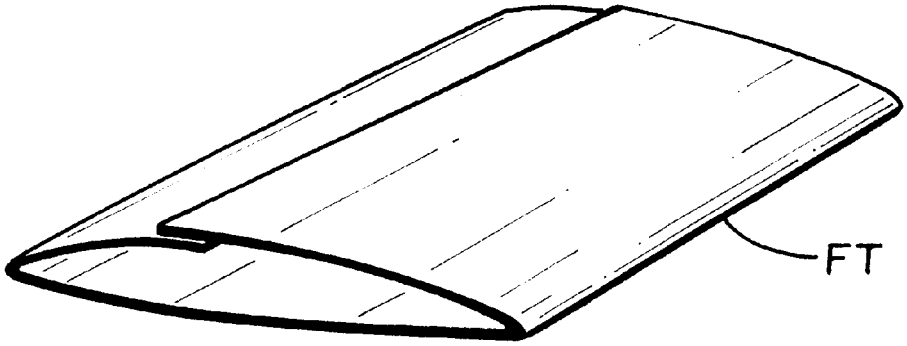
FIG. 4A is a schematic perspective view of a typical flat tube that may be formed with the apparatus of the invention.
Figure 4B:
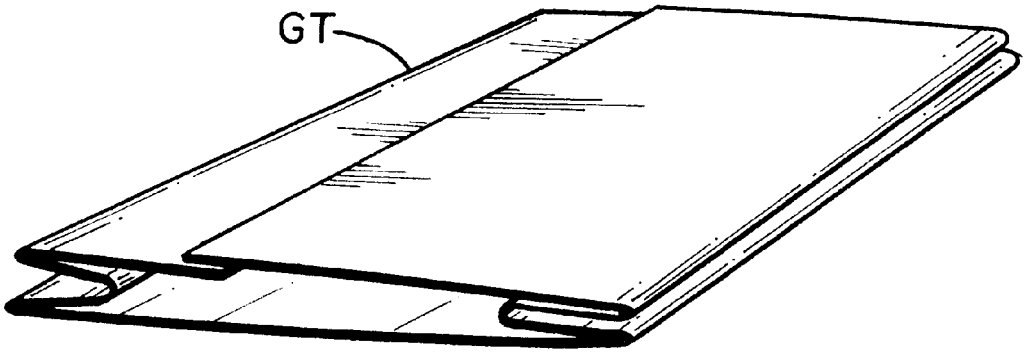
FIG. 4B is a schematic perspective view of a typical gusseted tube that may be produced in accordance with the invention.

The tube-forming section shown in FIGS. 1–3B is configured to form a flat tube FT as shown in FIG. 4A. If it is desired to produce another style of tube, e.g., a gusseted tube, the tube formers, i.e., rods 24 and rollers 25, must be removed and replaced with suitable tube formers for producing a gusseted side seam on the tube as it passes through the tube-forming section 23. A gusseted tube is shown at GT in FIG. 4B.

Upon leaving the tube-forming section 23, the paper tube passes through a breakerhead unit 27 which separates the tube into a plurality of discrete tubes of predetermined length that are then supplied through a counter/stacker unit 28 that counts and stacks the discrete tubes into bundles for further processing, e.g., to have one or more ends and/or handles and the like applied.

Although not shown, a printing unit may be provided to apply desired graphics to an outer ply so that it will be visible in the completed bag. The printing unit is normally positioned in association with the paper supply rolls 11.

The need for removing and replacing the tube formers to produce different styles of bags, as practiced in the prior art, is eliminated in the present invention, which provides multiple sets of pre-installed tube formers on opposite sides of an invertible former bed, whereby it is not necessary to remove and replace the tube formers, and instead, the former bed is simply inverted to bring a desired set of tube formers into registry with the outlet from the length pasting unit 22.

Figure 5:
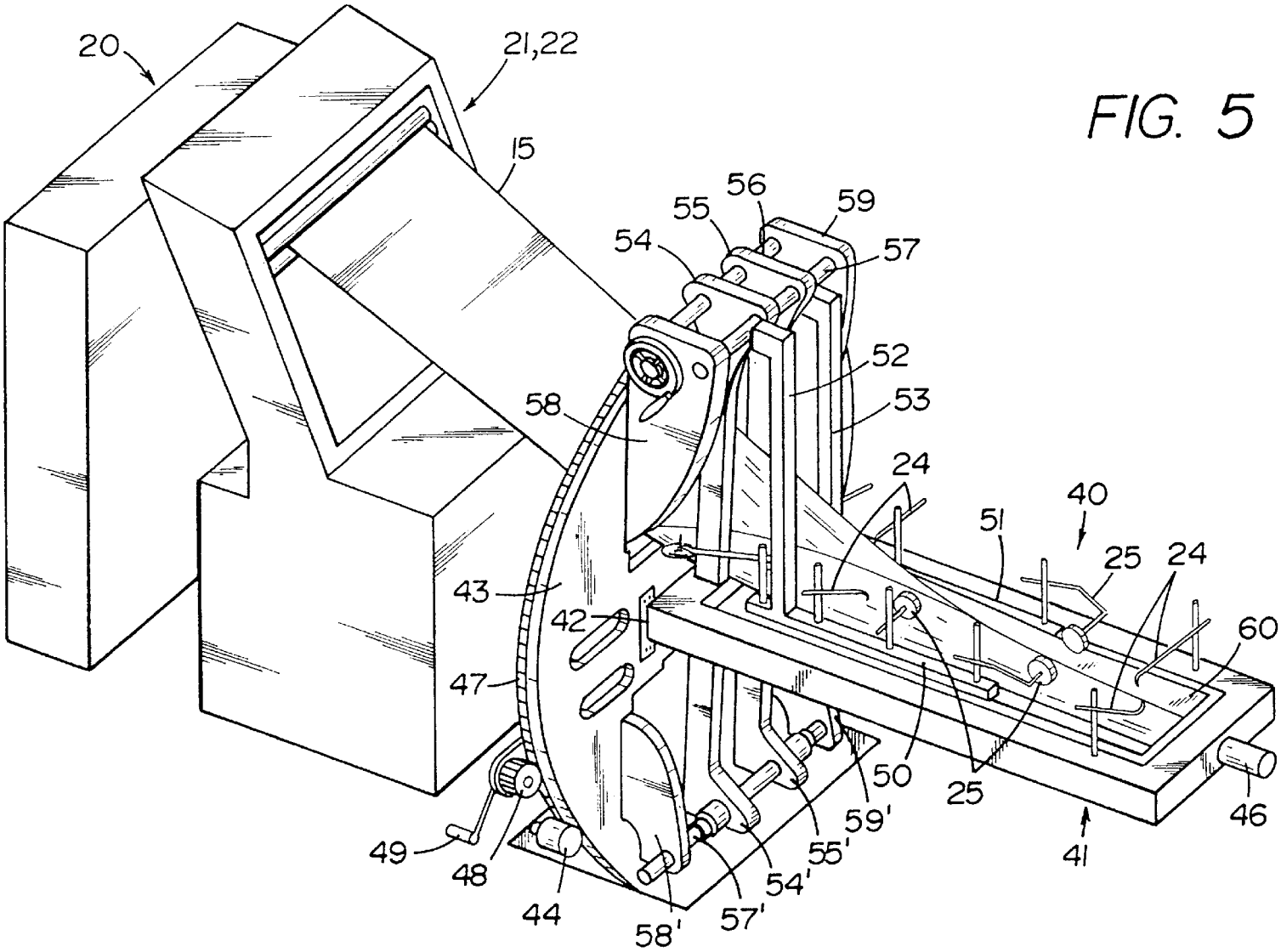
FIG. 5 is a fragmentary front perspective view of a portion of a tube-forming machine incorporating the novel tube forming section of the invention.
Figure 6:
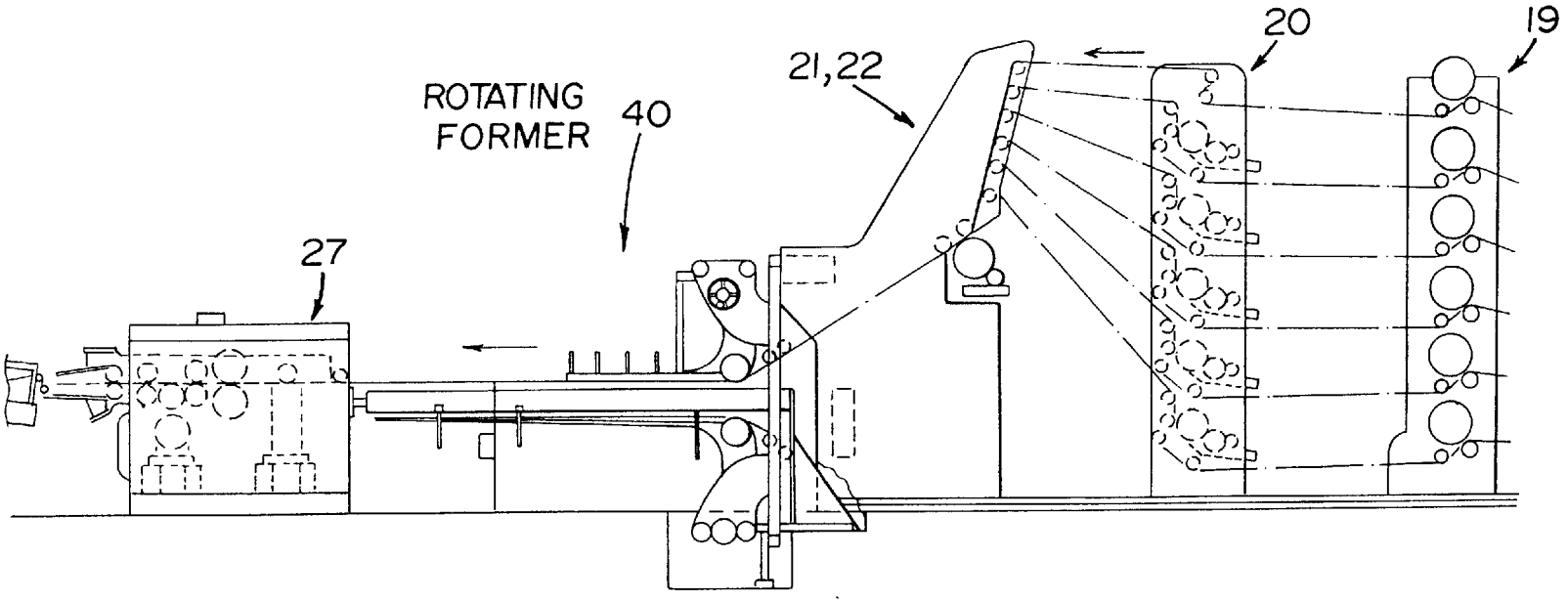
FIG. 6 is a fragmentary schematic side view in elevation of a portion of a tube-forming machine incorporating the tube forming section of the invention.

The invertible tube-forming section of the present invention is indicated generally at 40 in FIGS. 5 and 6, and comprises an invertible former bed 41 mounted at one end 42 to a rotatable ring 43 supported near its bottom on support rollers 44 and 45 at opposite sides of the ring. The opposite end of the former bed 41 is supported for rotation by a pivot shaft 46 engaged in a bearing on the breakerhead unit 27.

Suitable drive means, such as chain 47 on the periphery of the ring 43, and a sprocket 48 engaged with the chain, is provided to rotate the ring to invert the former bed when desired. The sprocket 48 may be driven by a manually actuated crank handle 49, or by other means, as desired. Moreover, gear teeth or drive means other than the chain and sprocket may be associated with the ring to rotate it through its operative range.

A suitable set of tube formers, including rods 24 and rollers 25, are mounted to the former bed 41 and to elongate former support arms 50 and 51 held in parallel relationship over one side of the former bed 41 by vertical support posts 52 and 53 carried at their upper ends on laterally adjustable mounting plates 54 and 55 slidable on shafts 56 and 57 that are supported at their opposite ends on mounting brackets 58 and 59 secured to the ring 43.

As shown in FIG. 5, the upwardly oriented operative side of the former bed 41 positioned to receive the paper from the length pasting unit 22 is configured to form a flat tube.

The laterally adjustable plates 54 and 55, which carry the arms 50,51 and 52,53, enable the positions of the tube formers to be adjusted to accommodate different widths of webs 15' supplied to the tube-forming section.

Additionally, although not shown in detail in the drawings, the former bed 41 carries a table or plate 60 on each of its opposite sides, over which the paper web passes as it is formed into a tube. The vertical position of the table is adjustable relative to the tube formers so that when it is desired or necessary to insert a new web of paper into the tube-forming section the table may be adjusted relative to the tube formers to provide room for an operator to insert the paper.

Figure 7:
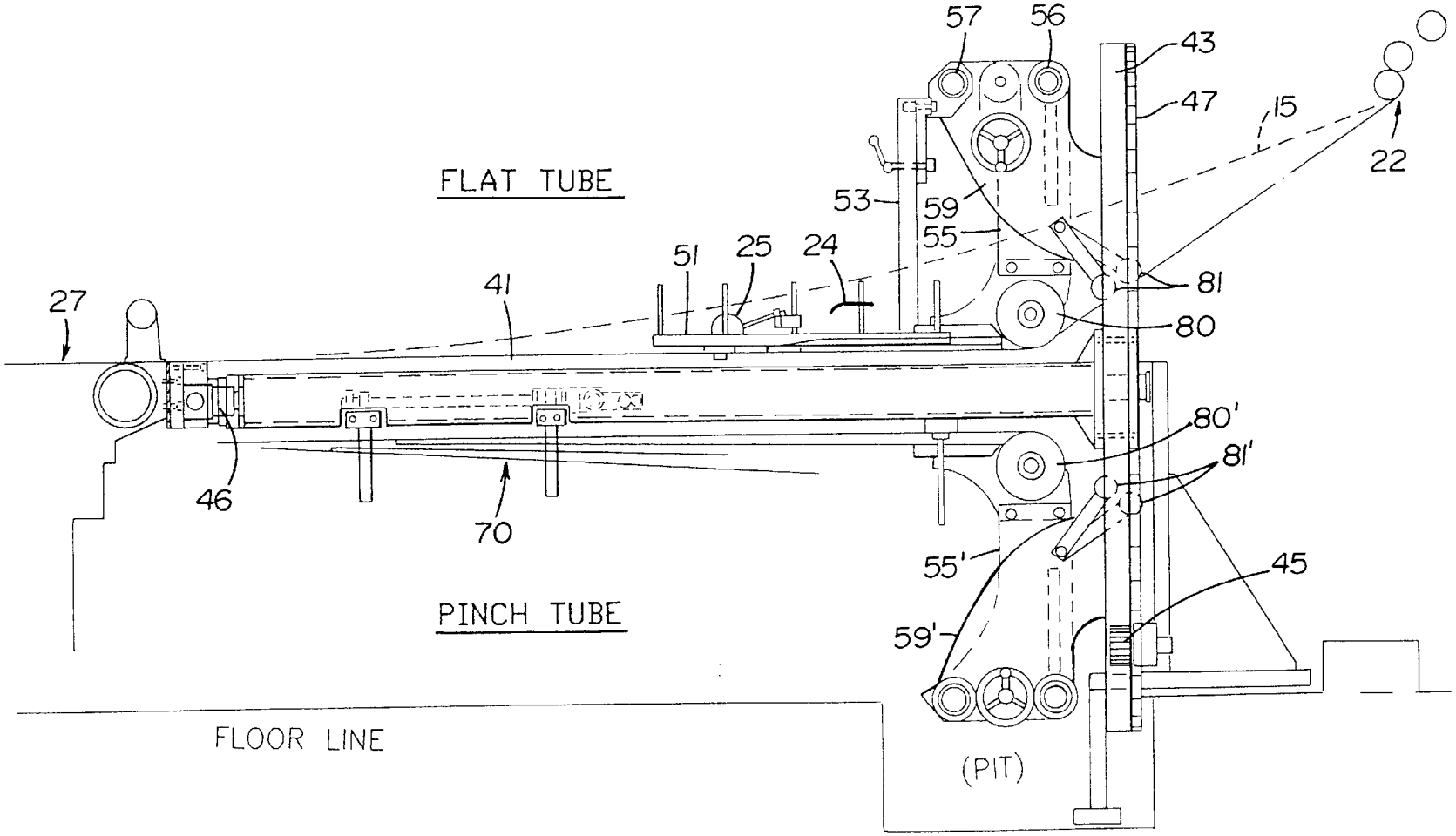
FIG. 7 is a partially schematic side view in elevation of the invertable tube-forming section of the invention.

As seen best in FIG. 7, gusset tube formers 70 are mounted to the underside of the former bed 41. Thus, when it is desired to convert the tube-forming machine from making flat tubes to making gusseted tubes, it is necessary only to separate or break the paper web 15' entering and leaving the tube-forming section, and to then rotate the tube-forming section to invert the bed 41 to bring the gusset formers 70 into the upward position in operative relationship for receiving the web 15' as it leaves the paste roll 22. The end of the web 15' leaving the paste roll is then inserted through the gusset former, across the top of the former bed 41 and into the breakerhead, at which time the machine is restarted and the web of paper is pulled through the tube-forming section to form a gusseted tube.

Figure 8:
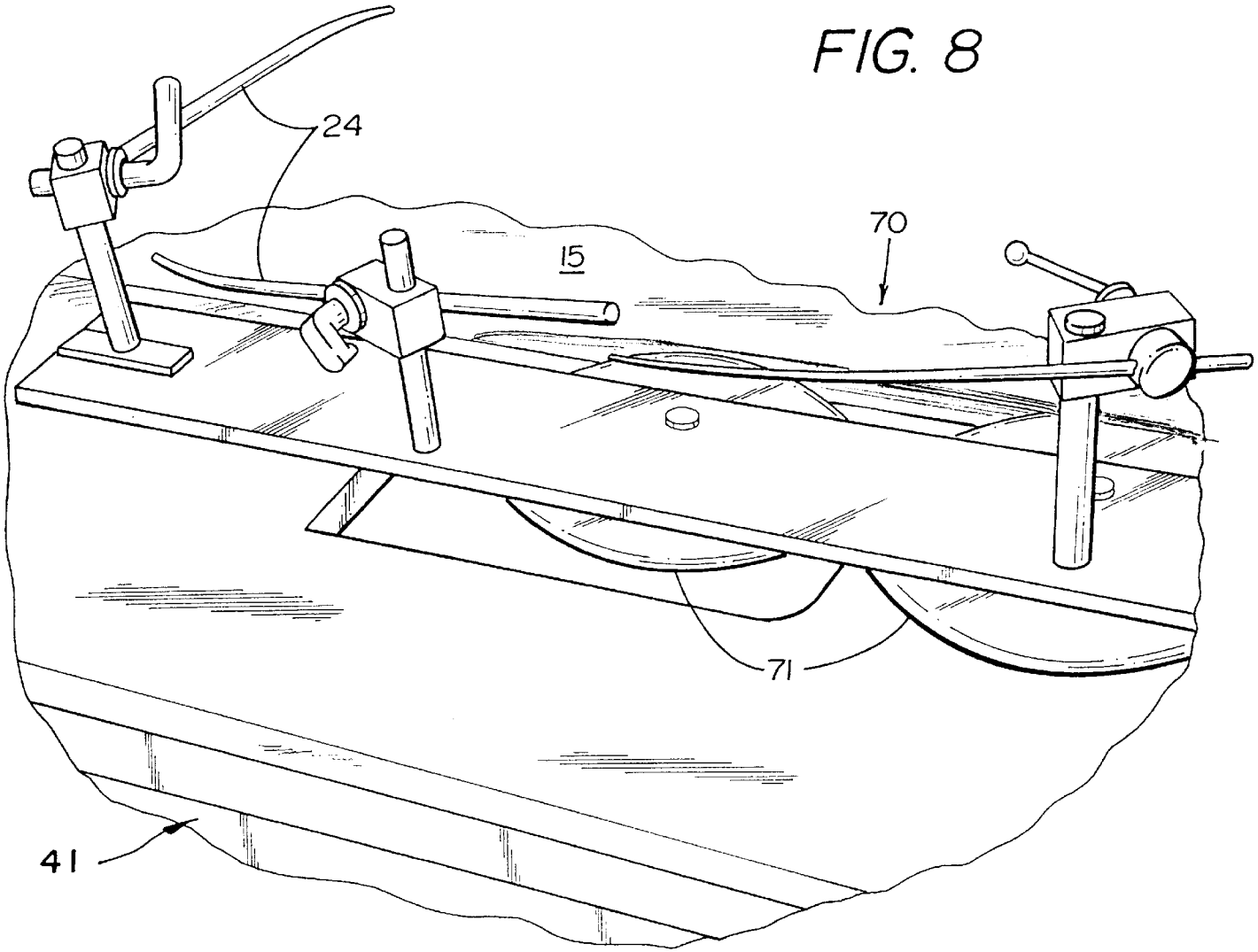
FIG. 8 is an enlarged fragmentary perspective view showing a portion of the former bed and gusset formers used in making a gusseted tube according to the invention.
Figure 9:
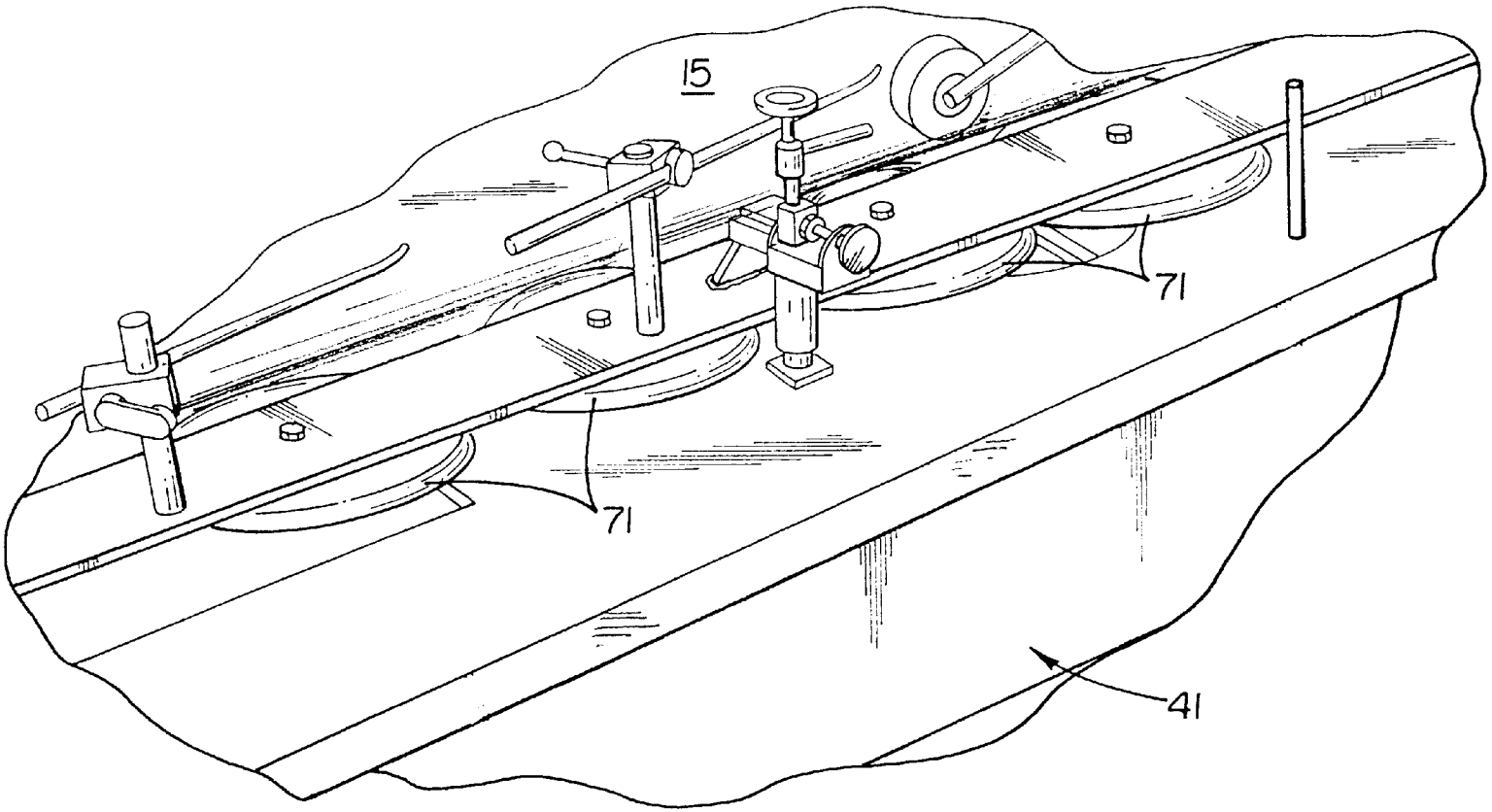
FIG. 9 is a fragmentary perspective view on a scale slightly reduced from that of FIG. 8, showing a portion of the former bed and gusset formers used in the invention.

The gusset formers are of conventional construction, and need not be described in detail herein. However, as seen best in FIGS. 8 and 9, the gusset formers include a plurality of rods 24 and horizontally disposed creasing rollers 71 which indent the opposite edges of the tube to form a gusset fold.

With the exception of the specific type of tube formers involved, the gusset forming side 70 of the tube-forming section 40 is essentially identical to the flat tube forming side, i.e., it includes the adjustable plates 54',55' carried on rods 56',57' supported at their opposite ends on mounting plates 58',59'.

Figure 11:
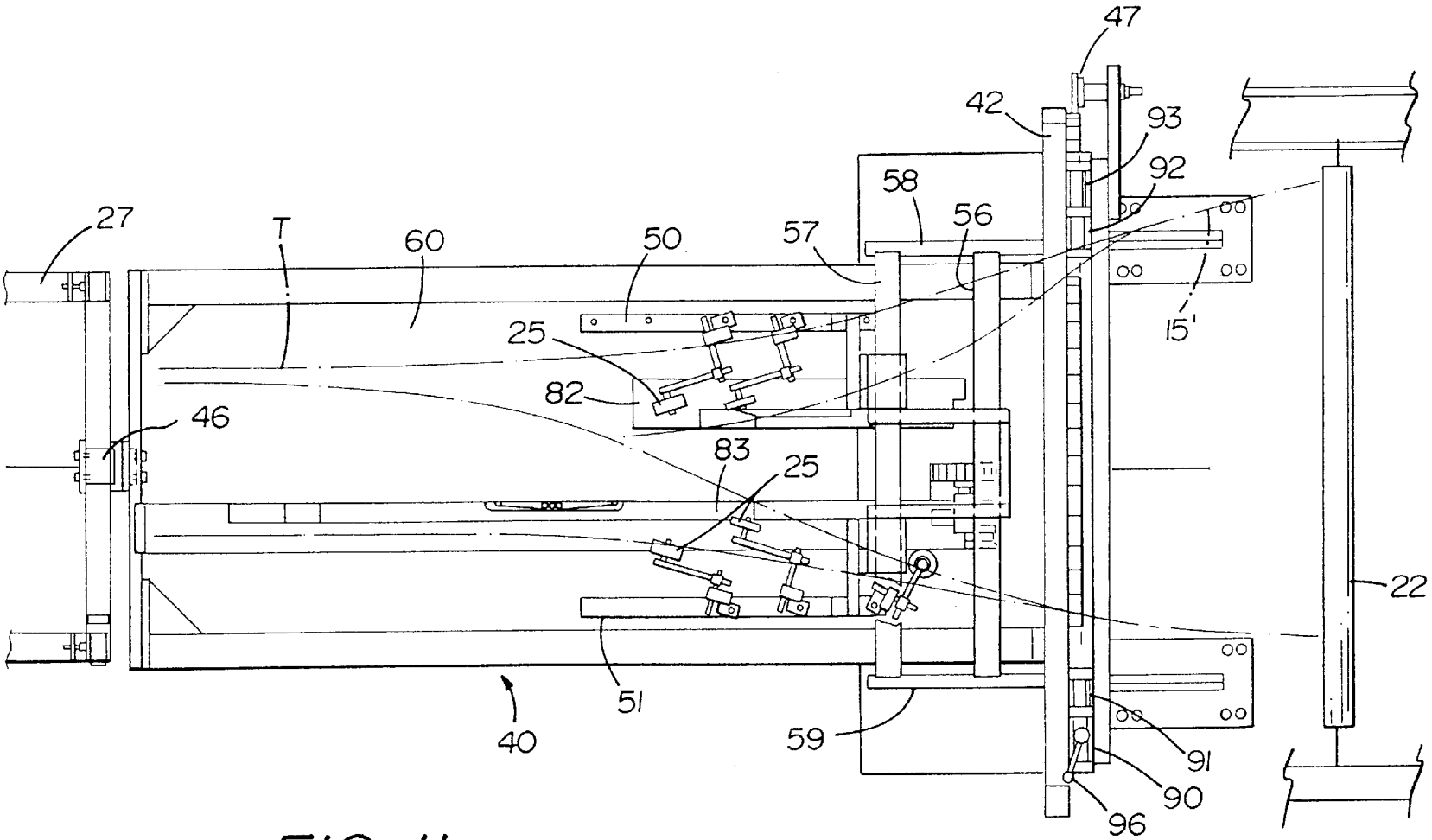
FIG. 11 is a somewhat schematic top plan view of the tube-forming section of the invention.
Figure 12:
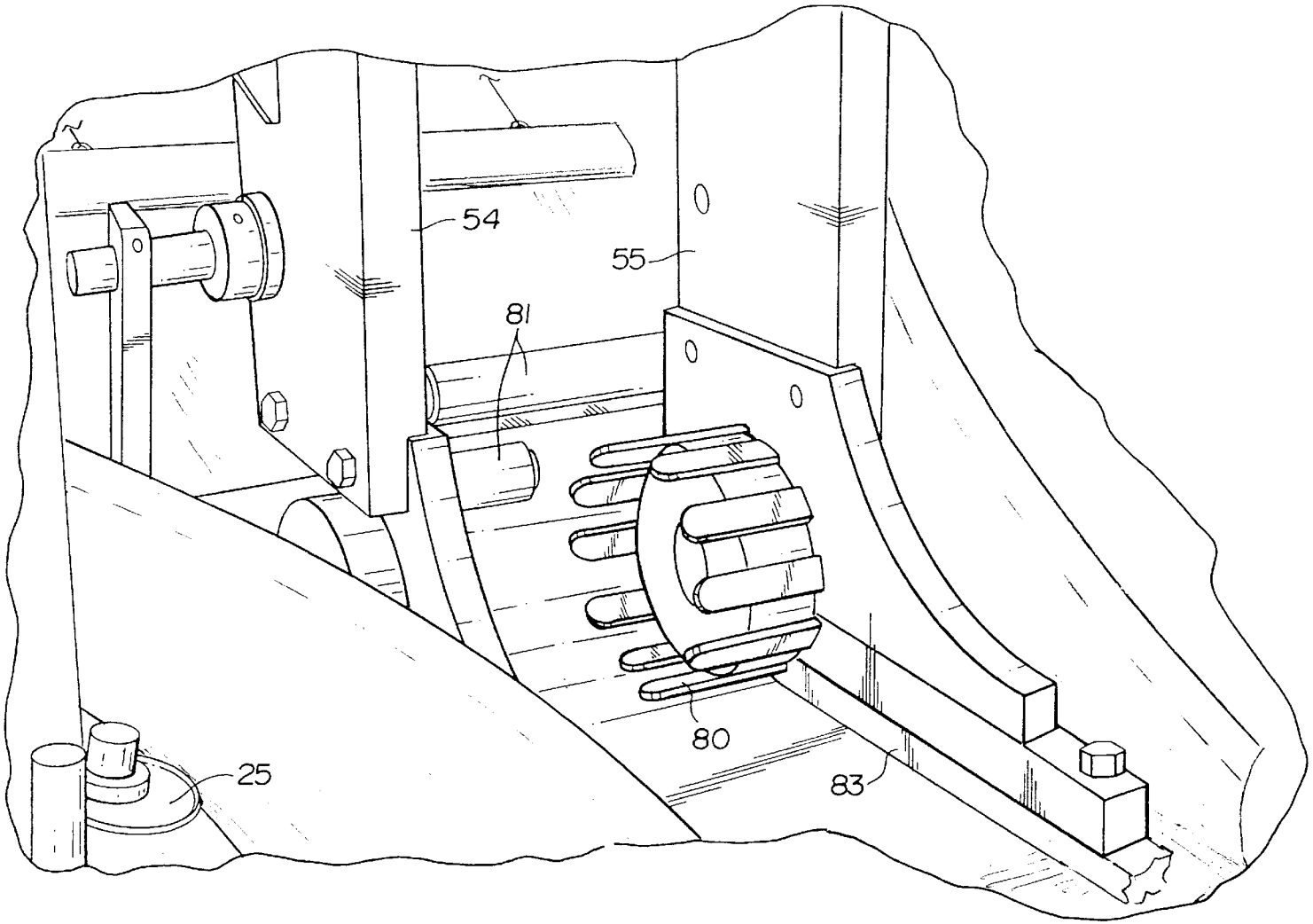
FIG. 12 is an enlarged, fragmentary, perspective view of a portion of the tube-forming section of the invention, showing the guide rollers for guiding the paper during its transition from the paste roll to the tube-forming section.

As seen best in FIGS. 7, 11 and 12, a plurality of guide rollers 80,81 and 80',81' are carried by the respective sets of adjustable plates 54,55 and 54',55', respectively, to guide the transition of the paper web 15' as it leaves the paste roll 22 and enters the tube-forming section.

Further, as seen in FIGS. 11 and 12, elongate flat guide plates 82 and 83 project forwardly from the lower ends of the adjustable plates 54 and 55 to hold the web in position to facilitate folding of the opposite side edges inwardly.

Figure 10:
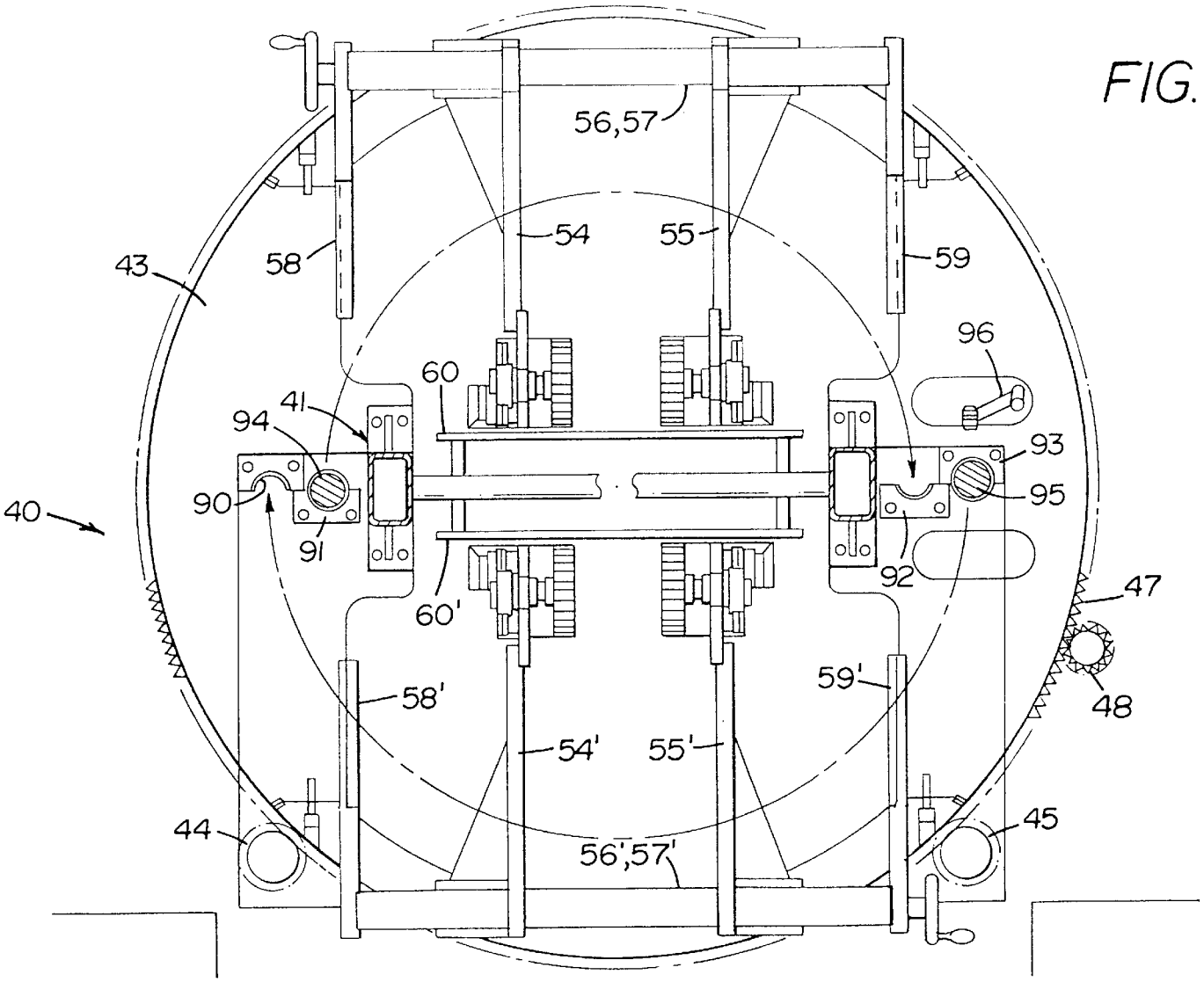
FIG. 10 is a somewhat schematic view in front elevation, with portions shown in section, of the former bed and associated ring and operating components of the tube-forming section of the invention.

FIG. 10 best illustrates the symmetry of the invertible tube-forming section, and also shows the saddles 90,91 and 92,93 which cooperate with spool-shaped stops 94 and 95 on the ring to positively locate and hold the rotatable former section in its operative positions. The saddles and stops are radially offset in pairs so that when the former section is rotated in a first direction, one set of saddles cooperate with the stops, and when rotated in the opposite direction another set of saddles cooperate with the stops to positively locate the former section in its operative rotated positions. A suitable fastener 96 is associated with at least one saddle and stop to secure the stop to the saddle and prevent inadvertent movement of the former out of its adjusted position.

It will also be noted in FIG. 10 that the chain does not extend all the way around the ring, but instead extends around only about 210°–220° of the circumference. Thus, the ring does not rotate through 360°, but only through 180°, as determined by the saddles and stops.

FIG. 11 is a somewhat schematic top plan view of the tube forming section 40 of the invention, showing how the web of paper 15' is folded inwardly from its opposite edges into overlapping relationship to form a tube T.

Figure 13:
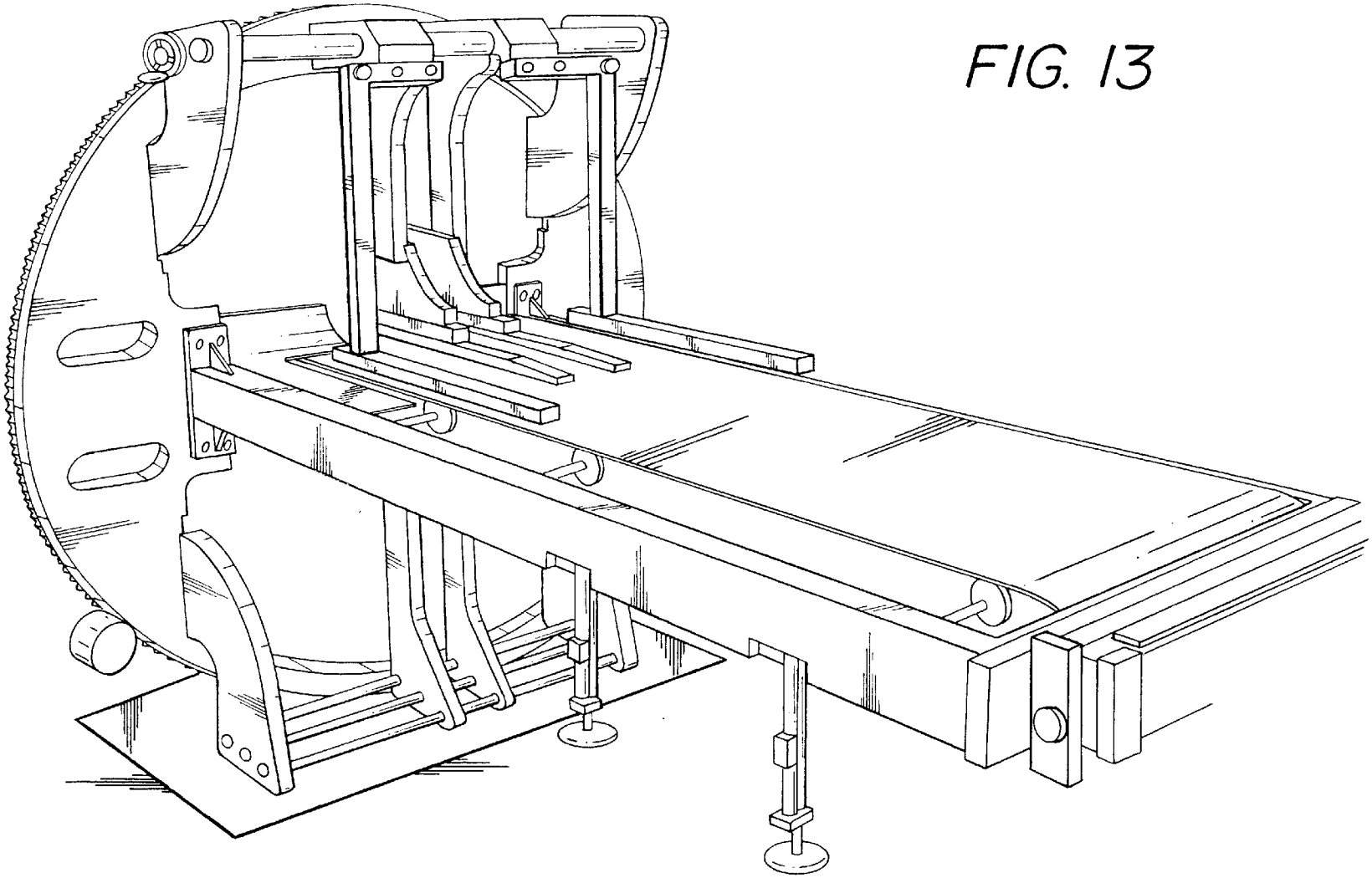
FIG. 13 is a front and top perspective view of the tube-forming section of the invention, shown in its operative condition for forming flat tubes.
Figure 14:
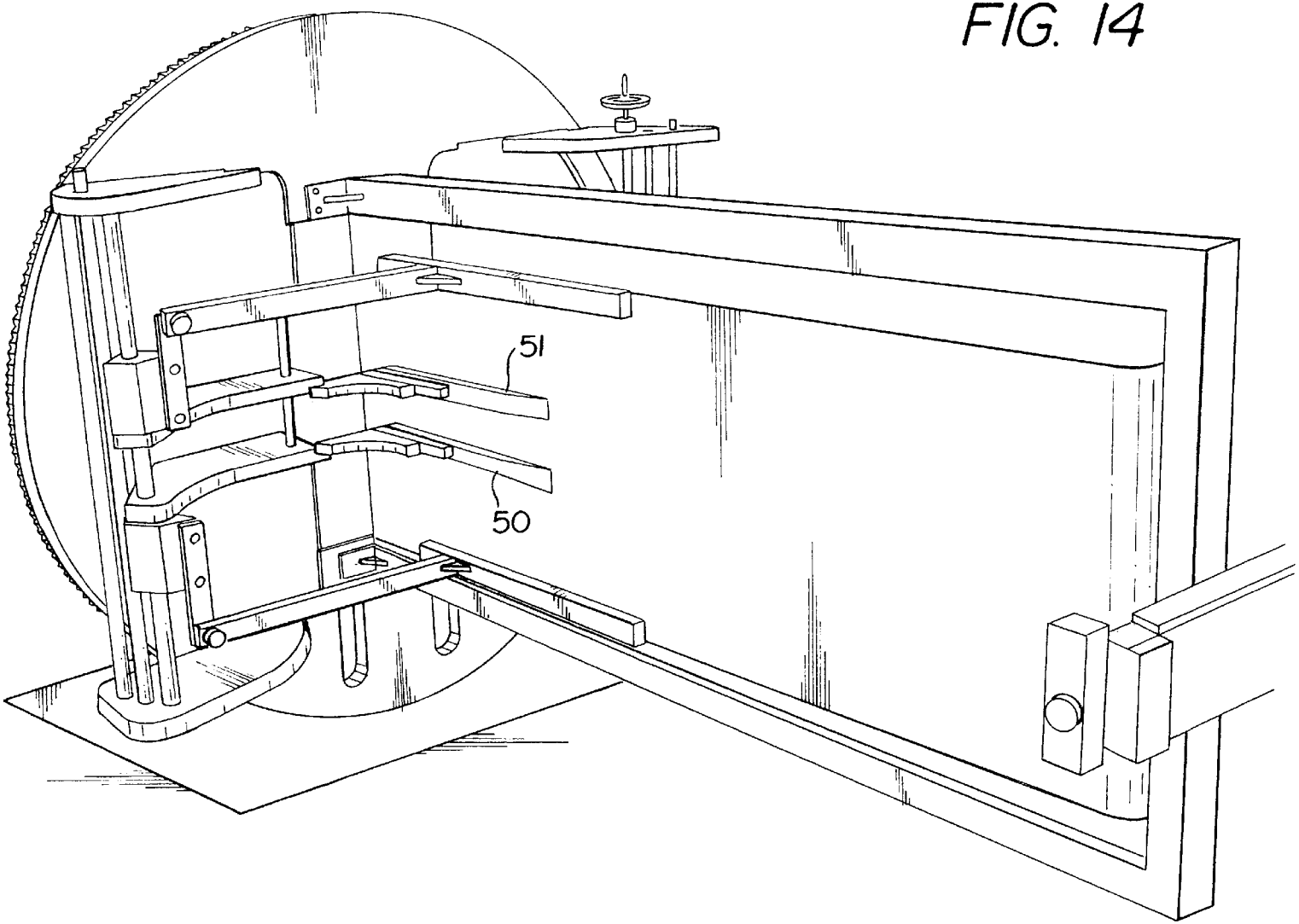
FIG. 14 is a top and front perspective view of the tube-forming section of FIG. 13; showing the tube-forming section rotated through 90° during its movement toward an alternate operative position for forming gusseted tubes.
Figure 15:
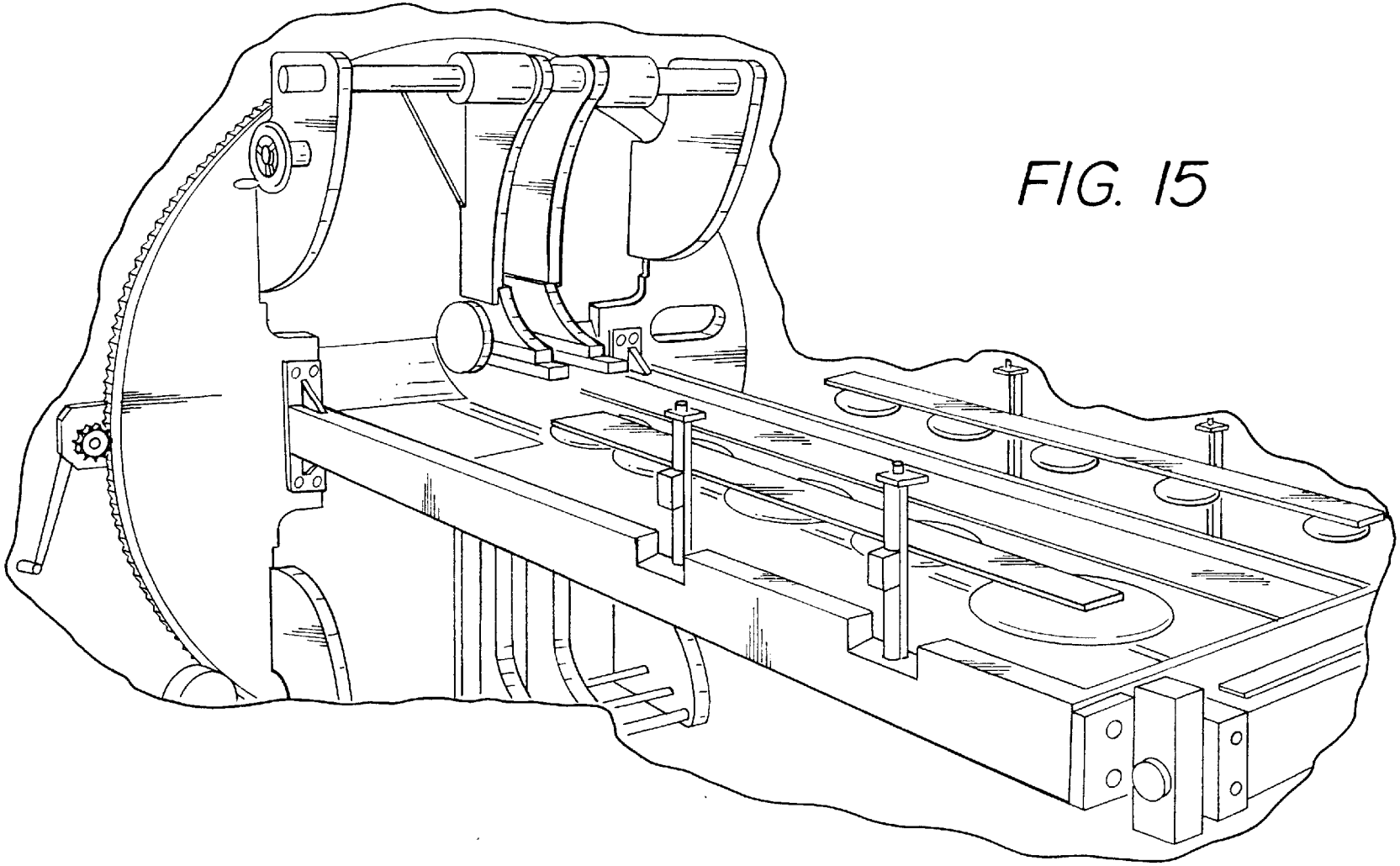
FIG. 15 is a front and top perspective view of the tube-forming section of FIGS. 13 and 14, showing the tube forming section in its operative position for making gusseted tubes.

FIGS. 13, 14, and 15 are somewhat schematic views illustrating how the tube-forming section 40 of the invention is rotated through 180° to invert the former bed 41 to bring either the flat tube-forming section or the gusseted tube-forming section into operative position. Thus, in FIG. 13, the former bed is shown in operative position to form flat tubes; in FIG. 14, the tube-forming section is shown rotated half way through its range from that shown in FIG. 13 to that shown in FIG. 15, where the former bed is oriented with the gusseted tube-forming section disposed upwardly in operative position.

Figure 16:
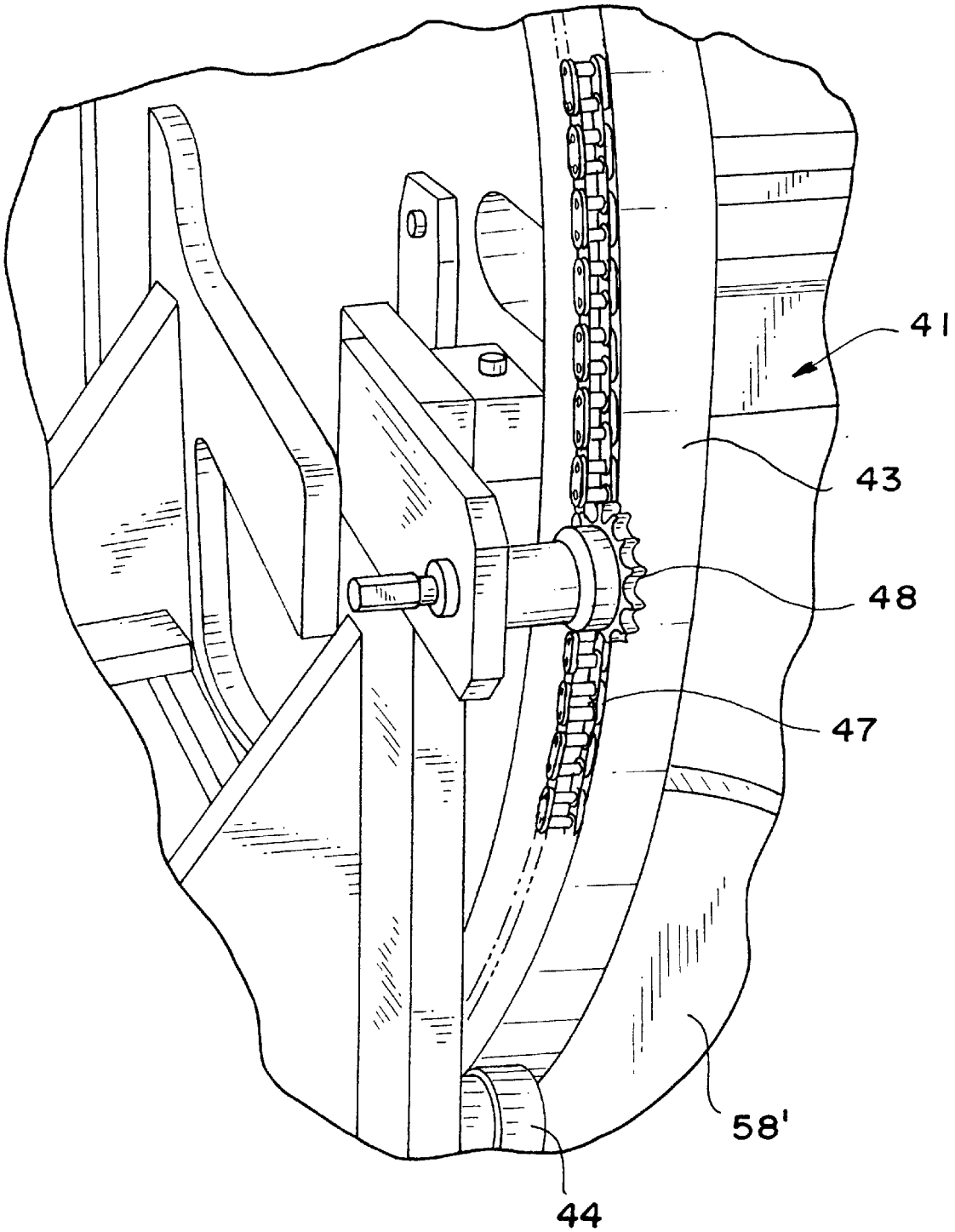
FIG. 16 is an enlarged, fragmentary, rear perspective view of a portion of the tube-forming section of the invention, showing the drive means for rotating the tube-forming section between its operative positions.
Figure 17:
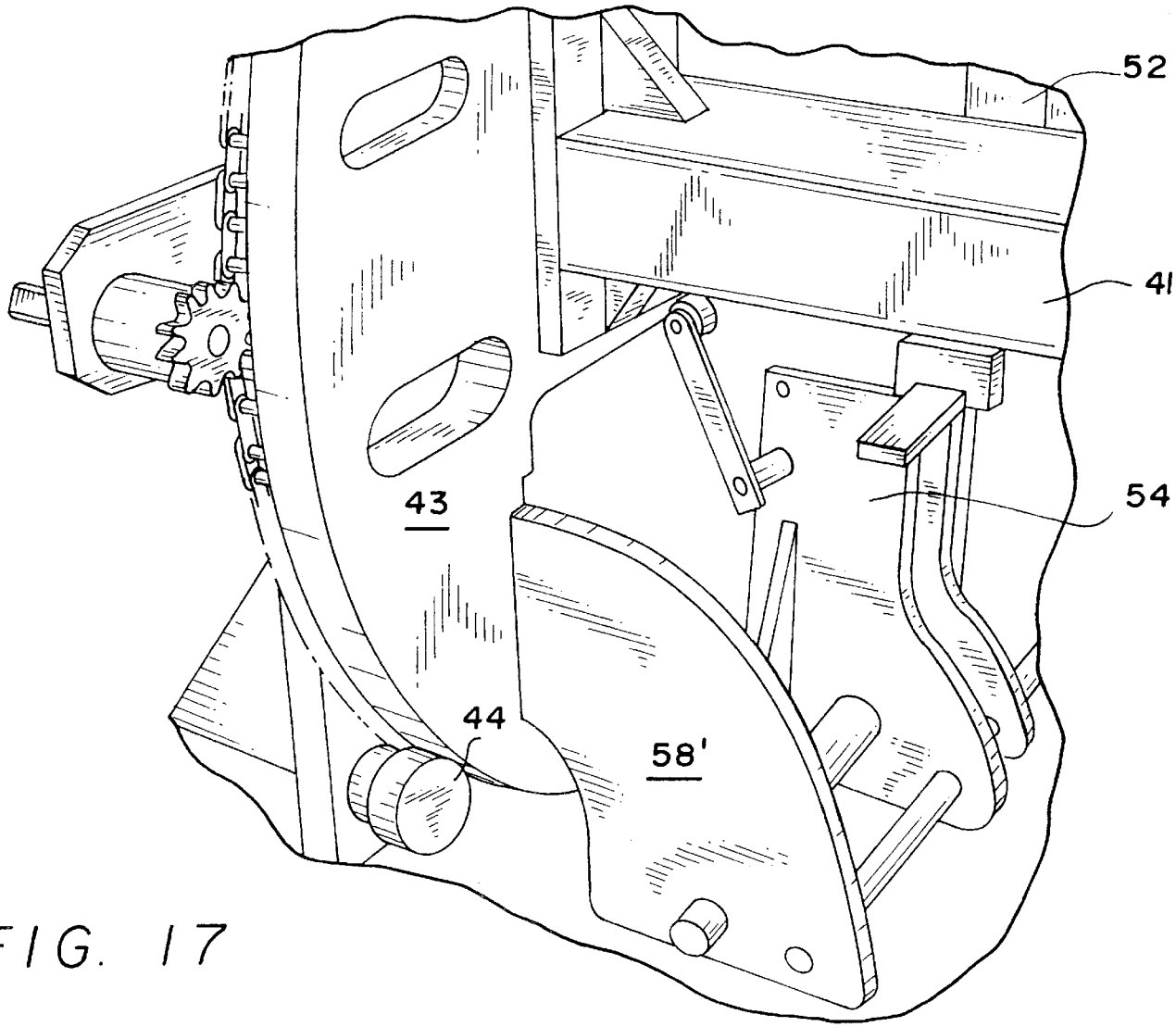
FIG. 17 is a fragmentary front perspective view of a portion of the tube-forming section of the invention, showing a portion of the drive means and one of the support rollers for supporting the ring of the tube-forming section.

FIGS. 16 and 17 are enlarged perspective views showing details of the tube-forming section support and drive means for rotating the tube-forming section into its operative positions.

While particular embodiments of the invention have been illustrated and described in detail herein, it should be understood that various changes and modifications may be made to the invention without departing from the spirit and intent of the invention as defined by the scope of the appended claims.

What is claimed is:

1. In a tube-forming machine for forming tubes from flat webs of material, wherein the machine includes means for supporting and supplying the webs to a tube-forming section that forms the webs into tubes, the improvement comprising:

a plurality of different sets of tube formers supported in the tube-forming section for forming different types of tubes, said sets of tube formers being selectively operatively positionable so that a first one of the sets of tube formers can be moved into position to form a first type of tube, and when desired another set of tube formers can be moved into said position to form a different type of tube without requiring removal of the first set of tube formers from the machine.

2. A tube-forming machine as claimed in claim 1, wherein:

the different sets of tube formers are mounted in different positions on a tube former support that is movable to bring a selected one of the sets into operative position.

3. A tube-forming machine as claimed in claim 2, wherein:

the tube former support comprises a generally horizontally disposed former bed having an upper surface and a lower surface; and one set of tube formers is mounted on the upper surface and another set of tube formers is mounted on the lower surface, said bed being rotatable to bring a selected one of said sets of the tube formers into operative position to form a tube.

4. A tube-forming machine as claimed in claim 3, wherein:

one set of tube formers is configured to form a flat tube, and another set is configured to form a gusseted tube.

5. A tube-forming machine as claimed in claim 3, wherein:

the former bed is rectangular in shape and has a first end supported to receive a web of material to be shaped into a tube, and a second end pivotally supported on a machine to receive the tube, said bed having a longitudinal axis and being rotatable about the axis.

6. A tube-forming machine as claimed in claim 5, wherein:

said first end of the bed is mounted to a rotatable ring; and drive means is associated with the ring to rotate the ring and the bed.

7. A tube-forming machine as claimed in claim 6, wherein:

stop means are associated with the ring to limit rotational movement thereof to predetermined positions.

8. A tube-forming machine as claimed in claim 7, wherein:

one set of tube formers is configured to form a flat tube, and another set is configured to form a gusseted tube.

9. In a tube-forming machine for forming tubes from flat webs of material, wherein the machine includes means for supporting and supplying the webs to a tube-forming section that forms the webs into tubes, the improvement comprising:

a plurality of different sets of tube formers supported in the tube-forming section for forming different types of tubes, said different sets of tube formers being mounted in different positions on a tube former support, and said tube former support and thus said sets of tube formers being selectively operatively positionable so that a selected one of the sets of tube formers can be moved into position to form a type of tube, depending upon which set of tube formers is in operative position.

10. A tube-forming machine as claimed in claim 9, wherein:

said tube former support comprises a former bed having a first surface and a second surface; and one set of tube formers is mounted on the first surface and another set of tube formers is mounted on the second surface, said bed being movable to bring a selected one of said sets of the tube formers into operative position to form a tube.

11. A tube-forming machine as claimed in claim 10, wherein:

the former bed is generally horizontally disposed, and has an upper surface and a lower surface comprising said first and second surfaces, respectively.

12. A tube-forming machine as claimed in claim 11, wherein:

said former bed has a longitudinal axis and is rotatable about said longitudinal axis to being one of said upper and lower surfaces and thus one of said sets of tube formers into operative position to receive the web of material to form a tube.

13. A tube-forming machine for forming tubes from flat webs of material in the manufacture of paper bags, comprising:

a tube-forming section that forms the webs into tubes;

means for supporting and supplying the webs to the tube-forming section;

means for receiving the formed tubes from the tube-forming section; and a plurality of different sets of tube formers supported in the tube-forming section, each set of tube formers being adapted to form a different type of tube, and each of said different sets of tube formers being selectively operatively movable into and out of operative position to form different types of tubes without requiring assembly and disassembly of the sets of tube formers from the machine.

14. A tube-forming machine as claimed in claim 13, wherein:

a tube former support is movably mounted in the tube-forming section; and said sets of tube formers are carried in different positions on the tube former support so that said tube former support may be moved to bring first one and then another of said sets of tube formers into operative position to receive the web of material to form a tube.

15. A tube-forming machine as claimed in claim 14, wherein:

the tube former support comprises a member having plural surfaces; and one set of tube formers is mounted on one surface and another set of tube formers is mounted on another surface, said member being movable to bring first one set and then another of the surfaces and thus the tube formers supported thereon into operative position to receive the web of material to form a tube.

16. A tube-forming machine as claimed in claim 15, wherein:

one set of tube formers is configured to form a flat tube, and the other set is configured to form a gusseted tube.

17. A tube-forming machine as claimed in claim 15, wherein:

the tube former support member comprises a generally horizontally disposed former bed having an upper surface and a lower surface and a longitudinal axis;

one of said tube former sets being carried on the upper surface and another of said tube former sets being carried on the lower surface; and said former bed being rotatable about its longitudinal axis to selectively bring first one and then another of the sets of tube formers carried on the upper and lower surfaces into operative position to receive the web of material.

18. A tube-forming machine as claimed in claim 17, wherein:

the former bed is rectangular in shape and has a first end supported to receive a web of material to be shaped into a tube, and a second end pivotally supported on a machine to receive the tube, said longitudinal axis extending between the first and second ends.

19. A tube forming machine as claimed in claim 18, wherein:

said first end of the bed is mounted to a rotatable ring: and drive means is associated with the ring to rotate the ring and the bed.

20. A tube forming machine as claimed in claim 19, wherein:

stop means are associated with the ring to limit rotational movement thereof to predetermined positions.

21. A tube-forming machine as claimed in claim 14, wherein:

the sets of tube formers are adjustably carried on the tube former support so that they may adjusted to different widths of webs to make different size tubes.

22. A tube-forming machine as claimed in claim 17, wherein:

the former bed includes a web support table on each surface, said tube former sets each being positioned adjacent a respective support table, and said support tables being adjustable relative to the tube former sets.

* * * * *